US007677708B2

(12) United States Patent
Kitamura et al.

(10) Patent No.: US 7,677,708 B2
(45) Date of Patent: Mar. 16, 2010

(54) DISCHARGE DEVICE

(75) Inventors: Kazumasa Kitamura, Itinomiya (JP); Kazuhiro Yamamoto, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 440 days.

(21) Appl. No.: 11/676,548

(22) Filed: Feb. 20, 2007

(65) Prior Publication Data

US 2007/0216734 A1 Sep. 20, 2007

(30) Foreign Application Priority Data

Mar. 17, 2006 (JP) ..... 2006-074673

(51) Int. Cl.
*B41J 2/045* (2006.01)

(52) U.S. Cl. ..... 347/71

(58) Field of Classification Search ..... 347/68, 347/69–72; 400/124.16

See application file for complete search history.

(56) References Cited

U.S. PATENT DOCUMENTS

| | | | |
|---|---|---|---|
| 5,818,482 | A | 10/1998 | Ohta et al. |
| 6,139,132 | A | 10/2000 | Yasukawa et al. |
| 6,460,981 | B1 | 10/2002 | Yasukawa et al. |
| 6,676,248 | B1 | 1/2004 | Hollands |
| 2002/0073543 | A1 | 6/2002 | Koda et al. |
| 2005/0001514 | A1 | 1/2005 | Takeuchi et al. |
| 2006/0214998 | A1 | 9/2006 | Sugahara |

FOREIGN PATENT DOCUMENTS

| | | | |
|---|---|---|---|
| EP | 1 070 589 | A2 | 1/2001 |
| EP | 1 364 793 | A1 | 11/2003 |
| JP | 3227285 | | 3/1995 |
| JP | 3298755 | | 6/1996 |
| JP | 3480481 | | 3/1998 |
| JP | 10-250072 | A1 | 9/1998 |
| JP | 2004-358716 | | 12/2004 |
| JP | 2005-019971 | | 1/2005 |
| JP | 3231523 | | 6/2005 |

*Primary Examiner*—K. Feggins
(74) *Attorney, Agent, or Firm*—Burr & Brown

(57) ABSTRACT

There is disclosed a small and thin ink jet head having an excellent productivity, in which Piezoelectric elements capable of developing a large displacement amount and a high displacement generation force can highly densely be arranged together with ink chambers and nozzles and in which generation of crosstalk is inhibited. A discharge device comprises a channel section in which a plurality of channels are formed, each channel having an introduction hole, a pressurizing chamber and a discharge hole; and an actuator section having a top plate, a pair of support walls arranged at opposite ends of the top plate and a plurality of piezoelectric elements hanging from the top plate, spread between the pair of support walls, arranged independently of one another and forming pairs with the channels.

11 Claims, 5 Drawing Sheets

DISCHARGE DEVICE

BACKGROUND OF THE INVENTION

1. Field of the Invention

The present invention relates to a discharge device which causes a change of a capacity of a pressurizing chamber by use of a strain induced by an electric field to discharge a fluid from the pressurizing chamber.

2. Description of the Related Art

In recent years, in apparatuses which perform printing such as a printer, a facsimile machine and a photocopier, most of printing systems have been performed by a non-impact laser or an ink jet head. Especially, in a small printer, a high-performance ink jet head is frequently used, and anyone can readily reproduce a clear image on paper as in a silver salt photograph as well known. The ink jet head mainly includes a piezoelectric system and a thermal jet (Bubble Jet (registered trademark) or the like) system in accordance with a difference of a mechanism which discharges ink. Among the systems, the ink jet head of the piezoelectric system is an ink jet head in which a piezoelectric element is used as a driving source, and the head mainly includes a nozzle, an ink chamber which communicates with an ink supply path and a piezoelectric element which changes a capacity of the ink chamber. In a printer (an ink jet printer) in which the ink jet head of the piezoelectric system is adopted, a driving voltage is applied to the piezoelectric element to change the capacity of the ink chamber in accordance with displacement of the element, and the ink is discharged from the nozzle of the ink chamber to thereby perform the printing. In the ink jet head of this piezoelectric system, unlike the thermal jet system, the ink is not heated. Therefore, the head advantageously has a high degree of freedom in selection of the ink, and an excellent controllability.

In such an ink jet head of the piezoelectric system, mainly improvements are demanded in order to realize denser printing at a higher speed and to achieve a broad range of properties of the ink to be handled, and to use a highly viscous liquid (ink) or a solvent-based liquid (ink) in which an organic solvent is used as a solvent.

(1) First, further improvements of arrangement densities of the piezoelectric elements and the ink chambers and further improvement of an ink discharge force are required. The further improvements of the arrangement densities are positioned as basic technical problems directly related to the realization of the dense printing at the high speed. The further improvement of the ink discharge force is a problem to be achieved in order to realize the discharging of a broad range of liquid (ink) such as pigment-containing ink or highly viscous ink.

(2) Next, inhibition of generation of crosstalk is required. When the piezoelectric elements are highly densely arranged, mutual interference (i.e., the crosstalk) is easily caused owing to displacements between the piezoelectric elements arranged adjacent to each other. This might deteriorate the ink discharge force or cause fluctuations in a discharge direction of the ink. Therefore, it could be an important problem to prevent the crosstalk from being easily caused.

(3) Furthermore, since the piezoelectric elements and the ink chambers are highly densely arranged, manufacturing steps might become complicated, and positions of the piezoelectric elements and the ink chambers might deviate to deteriorate yield. Therefore, a manufacturing method for avoiding these problems and a structure which is precisely and easily manufactured are important technical themes.

It is to be noted that to meet such improvement requirements, proposals have heretofore been made. Examples of prior art documents include Patent Documents 1 to 6:

[Patent Document 1] Japanese Patent No. 3298755;

[Patent Document 2] Japanese Patent Application Laid-Open No. 2004-358716;

[Patent Document 3] Japanese Patent No. 3227285;

[Patent Document 4] Japanese Patent Application Laid-Open No. 2005-19971;

[Patent Document 5] Japanese Patent No. 3231523; and

[Patent Document 6] Japanese Patent No. 3480481.

However, it has been considered that conventional technologies proposed in the prior art documents have problems, respectively. In an ink jet head disclosed in Patent Document 1, from the above viewpoint (2), piezoelectric elements to be actually driven for use in pressurizing ink chambers are arranged alternately with fixed piezoelectric elements which are not driven (see FIG. 4 of Patent Document 2). This configuration is adopted to inhibit generation of crosstalk. Therefore, it can be said that nozzles can be arranged as ink discharge ports at pitches which are only halves of those of the piezoelectric elements formed by mechanical processing (slit processing). Therefore, there is a limitation from the above viewpoint (1) which is a basic problem. An ink jet head disclosed in Patent Document 2 also has a similar problem.

In an ink jet head disclosed in Patent Document 3 and a cell driving type piezoelectric/electrostrictive actuator or micro pump according to Patent Document 4 proposed beforehand by the present applicant, there is not any piezoelectric element that is not driven. However, from the above viewpoint (2), an ink chamber is formed by two piezoelectric elements which are not shared by another ink chamber. This configuration is adopted to inhibit generation of crosstalk. Therefore, one nozzle is disposed for two piezoelectric elements. The nozzle can only be disposed at a pitch which is a half of that of the piezoelectric element in the same manner as in the ink jet head disclosed in Patent Document 1. Therefore, this structure is not necessarily preferable from the above viewpoint (1) which is the basic problem.

In Patent Document 5, there is proposed an on-demand type ink jet head including an actuator unit constituted by arranging, in one row, piezoelectric elements constituted by laminating a plurality of sets of piezoelectric materials and electrode materials; a plurality of rows of liquid chamber units with respect to the actuator unit; and nozzle units connected to the liquid chamber units. In this on-demand type ink jet head, a one-to-one correspondence exists between the piezoelectric element and the liquid chamber (the ink chamber), and high integration is easily achieved. It can be said that the head is preferable from the above viewpoint (1). Even when the high integration is achieved, there is not restriction on a shape of the liquid chamber. Therefore, it is possible to realize a high ink discharge efficiency. In this on-demand type ink jet head of Patent Document 5, however, a frame is disposed around the piezoelectric elements arranged in the actuator unit. In this frame portion, the actuator unit is integrally bonded to the liquid chamber unit including the ink liquid chambers. It is considered that rigidity is secured by such a structure and that the crosstalk is not easily caused (the above viewpoint (2)). Therefore, even when the piezoelectric elements and the liquid chambers can highly be integrated, the whole ink jet head enlarges. Moreover, separate units need to be bonded. In consideration of strengths required for the bonding, securement of position precisions of the units during the bonding and the like, from the above viewpoint (3), it can be said that the head has a large number of worries and that the head is not necessarily preferable. When a position of the piezoelectric element deviates from that of the liquid chamber (unit), a size and a configuration (a deformed shape) of deformation of a partition wall member in a vibration plate region change, fluctuations are generated in displacement of the liquid chamber, and high-quality printing cannot be performed.

Even in an ink jet head type recording head disclosed in Patent Document 6, a one-to-one correspondence is established between a piezoelectric vibrator (a piezoelectric element) and a pressure generation chamber (an ink chamber). In this respect, it can be said that the head has a preferable configuration from the above viewpoint (1). However, in this ink jet head type recording head, it is considered that the piezoelectric vibrator is inserted into a frame, and fixed to the frame via a fixed substrate to secure rigidity and inhibit generation of crosstalk (the above viewpoint (2)). The frame made of plastic or the like which is easily processed is adopted. Therefore, to secure strength of a structure, the frame remarkably enlarges as compared with sizes of the piezoelectric vibrator and the pressure generation chamber (see FIGS. 1 and 2 of Patent Document 6). To solve a problem of a coefficient of thermal expansion caused by the adoption of the frame made of plastic or the like, manufacturing requires a step of injecting an adhesive in a groove of the frame or the like. Therefore, even if the piezoelectric vibrators (the piezoelectric elements) and the pressure generation chambers (the ink chambers) can highly be integrated, the whole ink jet type recording head cannot be miniaturized. In consideration of manufacturing steps or the like, the head is not necessarily preferable from the above viewpoint (3). Since a distal end of the piezoelectric vibrator is not grasped, a position of the piezoelectric vibrator easily deviates from that of the pressure generation chamber. Therefore, fluctuations of displacement of the pressure generation chamber might be generated, and high-quality printing would not be realized.

SUMMARY OF THE INVENTION

The present invention has been divided in view of the above problems of the conventional technologies, and an object thereof is to provide an ink jet head which meets requirements that ink be discharged with a high resolution at a high speed in various manners as required by a printing apparatus in recent years. Specifically, an object is to provide a small and thin ink jet head having an excellent productivity, in which piezoelectric elements capable of developing a large displacement amount and a high ink discharge generation force are highly densely arranged together with ink chambers and nozzles and in which the piezoelectric elements can be precisely positioned with respect to the ink chambers to inhibit generation of crosstalk. Another object is to provide an ink jet head capable of discharging ink in which an organic solvent is used as a solvent. As a result of repeated investigations, it has been found that when the following discharge device is applied as the ink jet head, the above objects can be achieved.

That is, according to the present invention, there is provided a discharge device comprising: a channel section in which a plurality of channels are formed, each channel having an introduction hole into which a fluid is introduced, a pressurizing chamber which communicates with the introduction hole and a discharge hole which communicates with the pressurizing chamber to discharge the fluid; and an actuator section having a top plate, a pair of support walls arranged at opposite ends of the top plate and a plurality of piezoelectric elements hanging from the top plate, spread between the pair of support walls, arranged independently of one another and forming pairs with the channels, the top plate, the pair of support walls and the plurality of piezoelectric elements being formed of a ceramic material and integrally fired, ceiling walls of the pressurizing chambers constituting the channels of the channel section being relatively thin walls as compared with another portion, the actuator section being attached to the channel section so as to allow distal end surfaces of the piezoelectric elements hanging from the top plate of the actuator section to abut on the ceiling walls (the thin walls), the ceiling walls (the thin walls) being bent by displacements of the piezoelectric elements to change capacities of the pressurizing chambers, the fluid being pressurized to discharge the fluid from the discharge holes.

The discharge device according to the present invention further comprises pier walls arranged in parallel with the piezoelectric elements and hanging from the top plate externally from opposite sides of the plurality of arranged piezoelectric elements, the pier walls being formed of a ceramic material and fired integrally with the top plate.

In the present specification, inventive particulars are represented by terms such as the top plate and the ceiling walls. The terms such as top and ceiling indicate members arranged above in a case where the actuator section is disposed above and the channel section is disposed below. The terms do not indicate absolute positional relations. For example, a wall portion positioned on an upper side opposite to a gravity side is not necessarily the ceiling wall. The channel section is constituted of a channel which is a space, and a wall portion (a solid portion) which defines the channel. The introduction hole of the channel includes an introduction port, and the discharge hole includes a discharge port. The other portion is a portion (a side wall) other than the ceiling wall in the wall portion which defines the pressurizing chamber (the space). The ceiling wall (the thin wall) is a thin plate corresponding to a vibration plate of a general piezoelectric device. The distal end surface of the piezoelectric element allowed to abut on this ceiling wall in a distal end surface of the piezoelectric element opposite to the top plate from which the piezoelectric element hangs. The pressurizing chamber is a space corresponding to an ink chamber of a general ink jet head.

The piezoelectric elements hang from the top plate, are spread between the pair of support walls and fired integrally with the top plate and the pair of support walls. In other words, in the discharge device according to the present invention, portions of the piezoelectric element other than the distal end surface (on a side opposite to a side on which the element hangs from the top plate) and side surfaces (described later) are integrated with the top plate or the support wall, and fixed by the top plate and the support wall.

In a preferable configuration according to the present invention, the discharge device has the pier walls arranged in parallel with the piezoelectric elements and hanging from the top plate externally from the opposite sides of the plurality of arranged piezoelectric elements. This pier wall is an inactive wall portion (a solid portion) fired integrally with the top plate. Since the top plate, the pair of support walls and the plurality of piezoelectric elements are integrally fired, the top plate, the pair of support walls, the pier walls and the plurality of piezoelectric elements are integrally fired in the configuration having the pier walls. In this configuration, the pier walls reinforce the top plate, and rigidity of the actuator section is further improved. It is further preferable that the pier walls are connected to the pair of support walls to form a frame. The pier walls and the pair of support walls are fired integrally with the top plate. Therefore, when the frame is integrated with the top plate, the rigidity of the whole actuator section is further improved.

However, the plurality of piezoelectric elements are arranged independently of one another. One piezoelectric element is not directly connected to another piezoelectric element without interposing the top plate or the support walls. In the discharge device according to the present invention, the one piezoelectric element exists completely independently of the other piezoelectric element.

In the discharge device according to the present invention, it is preferable that each of the plurality of piezoelectric elements of the actuator section has layered piezoelectric bodies and electrodes which are alternately laminated, and the displacement is generated by a vertical effect. In this case, side surfaces of the piezoelectric element formed by laminated sections of the layered piezoelectric bodies and electrodes which are alternately laminated are constituted of fired surfaces. Furthermore, in this case, it is preferable that the piezoelectric body is not sandwiched between the electrodes constituting the piezoelectric element in the vicinity of the support wall.

The displacement of the piezoelectric element generated by the vertical effect is an expansion/contraction displacement in a laminating direction of the piezoelectric bodies and the electrodes. When a vibrator is considered, the vibrator has a vertical vibration (length vibration) mode. The laminating direction is a direction vertical to the surfaces of the layered piezoelectric bodies or electrodes.

In the discharge device according to the present invention, the distal end surface of the piezoelectric element is allowed to abut on the ceiling wall of the pressurizing chamber. However, this means that the piezoelectric element abuts on the ceiling wall at one or both instances that the piezoelectric element expands and/or a time when the piezoelectric element contracts in a case where the displacement is generated in the piezoelectric element by the vertical effect. The distal end surface of the piezoelectric element may directly abut on the ceiling wall of the pressurizing chamber. However, in a configuration in which the distal end surface of the piezoelectric element is allowed to abut on the ceiling wall of the pressurizing chamber, as mentioned in the present specification, it is assumed to include a configuration in which the distal end surface of the piezoelectric element abuts on the ceiling wall of the pressurizing chamber via a protruding portion or the like. However, the distal end surface of the piezoelectric element may be or may not be secured to the ceiling wall. That is, in the discharge device according to the present invention, the ceiling wall of the pressurizing chamber is bent by the expansion/contraction displacement to change the capacity of the chamber. However, when the distal end surface of the piezoelectric element is not secured to the ceiling wall, the ceiling wall can be thrust and bent by expansion displacement to reduce the capacity of the pressurizing chamber, and the ceiling wall can be returned to a flat (original) state by contraction displacement to restore the capacity of the pressurizing chamber. On the other hand, when the distal end surface of the piezoelectric element is secured to the ceiling wall, in addition, the ceiling wall can be pulled and bent by the contraction displacement to increase the capacity of the pressurizing chamber, and the ceiling wall can be returned to the flat (original) state by the expansion displacement to return the capacity of the pressurizing chamber to a usual state.

The fired surface is at least a surface (a surface unprocessed after fired) which is not subjected to processing after firing. That is, unlike the piezoelectric element of the ink jet head of the prior art (see, e.g., Patent Document 1), the piezoelectric element of the discharge device according to the present invention is not obtained by subjecting a substrate formed of a piezoelectric material to mechanical processing to form a slit. The electrode constituting the piezoelectric element is constituted of a positive electrode (a driving (signal) electrode) and a negative electrode (a common electrode) between which the piezoelectric body is sandwiched.

There is not any restriction on the number of the layered piezoelectric bodies, and one or a plurality of piezoelectric bodies may be used. The minimum constitution of the piezoelectric element is a configuration in which one layer of piezoelectric body is sandwiched between a pair of formed electrodes. The representation of the layered piezoelectric bodies does not limit a thickness of the piezoelectric body. To improve displacement efficiency, it is preferable that the piezoelectric body is rather thin and multilayered. On the other hand, when the piezoelectric body is thickened, short-circuit between the electrodes does not easily occur. Therefore, it is possible to apply a higher voltage as compared with the thin body. When the higher voltage is applied, the displacement can further be enlarged. A preferable thickness of the piezoelectric body is 10 to 300 μm per layer, more preferably 40 to 100 μm. Furthermore, in the present specification, there is not any restriction, but a preferable electrode is a thin film-like electrode. A preferable thickness of the electrode is 1 to 20 μm per layer, more preferably 3 to 10 μm.

In a portion in which the electrodes exist without interposing any piezoelectric body between the electrodes, any displacement does not occur. The portion in which the electrodes constituting the piezoelectric element exist without interposing any piezoelectric body between the electrodes means an inactive portion. Moreover, the piezoelectric elements are spread between the pair of support walls. Therefore, when the electrodes constituting the piezoelectric element exist in the vicinity of the support wall without interposing any piezoelectric body between the electrodes, it is indicated that all of the piezoelectric elements are not constituted of active portions, and the elements in the vicinity of (a portion close to a portion bonded to the support wall) the support wall are constituted of inactive portions.

In the discharge device according to the present invention, it is preferable that any retreated step portion is not present in the channel section.

The retreated step portion is a recessed step portion seen in the wall portion (the solid portion) of the channel section forming the channel (the space). In the ink jet head of the prior art (see, e.g., Patent Document 5), (a portion corresponding to) the channel section is prepared by injection molding of a polymer resin or laminating of metal plates. In the latter attaching method, an adhesive or an adhesive sheet is used, and the adhesive or the adhesive sheet is not present in a marginal portion of an end surface of each metal plate to be laminated so that the adhesive or the adhesive sheet does not protrude to the channel. The discharge device according to the present invention is different from the conventional ink jet head in that the device is constituted of the channel section in which such a retreated step portion is not present.

In the discharge device according to the present invention, it is preferable that the channel section is formed of a ceramic material.

In the discharge device according to the present invention, it is preferable that the actuator section and the channel section are formed of a piezoelectric ceramic material, and integrally fired.

Next, the present invention is directed to a method of manufacturing the above discharge device in which each of a plurality of piezoelectric elements of an actuator section has layered piezoelectric bodies and electrodes alternately laminated and in which displacement is generated by a vertical effect, the method comprising: a step 1a of preparing a plurality of green sheets A including a ceramic material as a main component, and making hole portions a constituting channels during the laminating in the green sheets A; a step 1b of preparing a plurality of green sheets B including a piezoelectric ceramic material as a main component, forming conductive films constituting later the electrodes on the green sheets B and then making hole portions b forming later spaces among the plurality of piezoelectric elements arranged independently of one another in the green sheets B; a step 1c of preparing a green sheet C including a ceramic material as a main component and constituting a top plate later; and a second step of laminating the green sheets A including the hole portions a so as to form the channels, laminating the green sheets B including the conductive films and the hole portions b so as to form the piezoelectric elements, laminating the green sheet C on the green sheets B, pressing the whole of the green sheets to form a laminated green body, and integrally firing the laminated green body to obtain a fired laminated body.

There is not any restriction on an order of the steps 1a, 1b and 1c. After completing these steps, the second step is performed, and the fired laminated body obtained after the second step is subjected to a wiring treatment to the outside, a polarization treatment and the like to thereby obtain the discharge device. The piezoelectric ceramic material is included in the ceramic material, and the main component of all the green sheets may be the piezoelectric ceramic material.

It is to be noted that in the present specification, the piezoelectric elements constituting the actuator section are piezoelectric, but the elements utilized are strain induced by an electric field. The element is not limited to a piezoelectric element utilizing an inverse piezoelectric effect to generate a strain amount which is substantially proportional to the applied electric field in a narrow sense. The element also includes an element utilizing a phenomenon such as an electrostrictive effect to generate a strain amount substantially proportional to a square of the applied electric field, reverse polarization seen in a general ferroelectric material or an antiferroelectric phase-ferroelectric phase transition seen in an antiferroelectric material. Therefore, it is appropriately determined whether or not to perform a treatment related to polarization during manufacturing based on a property of the piezoelectric ceramic material for use in the piezoelectric body of the piezoelectric element constituting the discharge device according to the present invention.

In the discharge device according to the present invention, the plurality of channels are formed, and the device has the piezoelectric element forming pairs with the channels. That is, in the discharge device according to the present invention, a one-to-one correspondence is established between the discharge hole or the pressurizing chamber and the piezoelectric element. Therefore, the discharge holes can be highly densely arranged. When the discharge device according to the present invention is adopted as the ink jet head, it is possible to realize printing with a high resolution.

In the discharge device according to the present invention, the plurality of piezoelectric elements hang from the top plate, and are continuously spread between the pair of support walls. The portions of the piezoelectric element other than the distal end surface and the side surfaces are integrated with and fixed to the top plate and the support walls. Three places (three directions) of one piezoelectric element are fixed, and the piezoelectric element is not subjected to the mechanical processing. Therefore, the position of the distal end surface of the piezoelectric element does not easily deviate, the element has an excellent positional precision with respect to the pressurizing chamber, any fluctuation of the displacement (deformation) is not generated in the pressurizing chamber, and it is possible to realize dense and clear printing with a high resolution. In the conventional ink jet head disclosed in, for example, Patent Documents 5 and 6, since a distal end portion of the piezoelectric element is not grasped, there is a possibility that the positional precision between the distal end portion of the piezoelectric element (the corresponding portion) and the ink chamber (the corresponding portion) deteriorates owing to fluctuations generated during processing and assembling in preparing the piezoelectric element. The precision of the position of the piezoelectric element with respect to the position of the ink chamber largely influences displacement characteristics (deformation characteristics) of the ink chamber. When the center of a width of the ink chamber agrees with the center of the piezoelectric element, the displacement (the deformation) can most efficiently be performed. However, when the precisions of the positions of the piezoelectric element and the ink chamber deteriorate, the displacement characteristics (the deformation characteristics) deteriorate, or the fluctuations are generated in the displacement characteristics (the deformation characteristics). In this case, it is impossible to realize the dense and clear printing with the high resolution. According to the discharge device of the present invention, since the piezoelectric element has the excellent positional precision with respect to the pressurizing chamber, it does not face such a problem.

Alternatively, in general, in a case where the piezoelectric element having a straight shape is displaced in an axial direction of the element, different vibration modes are generated at a time when a force of binding this displacement is generated and at a time when any binding force does not act. That is, the vibration at the time when any binding force does not act expands the element in the only axial direction. When the binding force acts, a bent vibration mode is generated in another direction that is not straight. In this case, as a result, when the piezoelectric element (the corresponding portion) acts, a size and a direction of the force to the ink chamber (the corresponding portion) fluctuates, and this might be a hampering factor in realizing dense printing. In the discharge device according to the present invention, when the three places (the three directions) of one piezoelectric element are fixed, the rigidity of the piezoelectric element is improved, and the generation of the bending vibration mode is inhibited. Therefore, the position of the piezoelectric element with respect to the pressurizing chamber does not fluctuate during operation, and it is possible to realize the dense and clear printing with the high resolution.

Furthermore, in the discharge device according to the present invention, when the rigidity of the piezoelectric element improves, a resonance frequency increases. Therefore, a discharge driving frequency increases, and the discharging at a high speed can be achieved. Therefore, as compared with when the three places of the piezoelectric element are not fixed, it is possible to realize the printing at a higher speed.

In addition, in the discharge device according to the present invention, the rigidity of a structure in which the three places of one piezoelectric element are fixed is secured. Therefore, the top plate and the support walls which are elements constituting the structure can be formed to be smaller as compared with a case where the three places of the piezoelectric element are not fixed. Specifically, since the discharge device according to the present invention is constituted by integrally firing the piezoelectric elements, the top plate and the support walls, a structure for separately preparing and assembling these components and an area for realizing the structure are not required. There is not any interface where a plurality of members are integrally fired and bonded. Therefore, the rigidity improves. In consequence, the whole discharge device according to the present invention can easily be miniaturized. In addition, in the preferable configuration of the discharge device according to the present invention, the whole device (the actuator section and the channel section) is integrally fired. Therefore, without enlarging or thickening the top plate and the support walls, a remarkably high strength of the structure can be held. In this respect, the discharge device according to the present invention is advantageous in that the discharge holes, the pressurizing chambers and the piezoelectric elements are highly integrated and the whole discharge device is miniaturized. In the ink jet head disclosed in, for example, Patent Documents 5 and 6, the frame enlarges, and it is difficult to miniaturize the whole ink jet head. However, according to the present invention, such problems can be avoided.

In the discharge device according to the present invention, the plurality of piezoelectric elements are attached to the top plate so as to hang from the plate, continuously spread between the pair of support walls, and arranged completely independently of one another. Therefore, the displacement generated in one piezoelectric element does not propagate to another piezoelectric element, interference of one piezoelectric element to the other piezoelectric element is suppressed, and the problem of crosstalk does not easily occur. Therefore, when the device is used as the ink jet head, it is possible to realize denser and clearer printing as compared with an ink jet head in which crosstalk easily occurs.

In the preferable configuration, the discharge device according to the present invention has the pier walls arranged in parallel with the piezoelectric elements externally from the opposite sides of the plurality of arranged piezoelectric elements. Therefore, the actuator section has very high rigidity. In consequence, unlike a configuration in which any pier wall is not disposed, the piezoelectric elements can be driven in a more stabilized vibration mode (the piezoelectric elements can be displaced), and the device has a very excellent fluid discharge stability.

In the preferable configuration of the discharge device according to the present invention, each of the plurality of piezoelectric elements of the actuator section is a laminated piezoelectric element having layered piezoelectric bodies and electrodes which are alternately laminated. The displacement is generated by the vertical effect. Therefore, in view of the displacement characteristics of the piezoelectric element, since a piezoelectric constant of the vertical effect is larger than that of a lateral effect, the piezoelectric element can be constituted to be thinner and lower as compared with the piezoelectric element in which the displacement is generated by the lateral effect. Therefore, the present invention is advantageous in thinning the whole discharge device as compared with the ink jet head in which the lateral effect is used. For example, in the ink jet type recording head shown in FIG. 2 of Patent Document 6 in which the piezoelectric element (the piezoelectric vibrator) having the displacement generated by the lateral effect is used, since the displacement amount is proportional to the length (the height) of the piezoelectric body, a large displacement amount cannot be obtained from the low piezoelectric element. It is necessarily difficult to constitute the whole ink jet type recording head to be thin. However, according to the present invention, such a problem can be avoided. In addition, when the piezoelectric body is further thinned, the piezoelectric element can be operated with a low driving voltage as compared with the piezoelectric element in which the displacement is generated by the lateral effect.

In the preferable configuration of the discharge device according to the present invention, the ceiling wall (the thin wall) of the pressurizing chamber is bent by the displacement of the piezoelectric element based on the vertical effect to change the capacity of the pressurizing chamber, and the fluid is pressurized to discharge the fluid from the discharge holes. That is, in the discharge device according to the present invention, the strain based on the inverse piezoelectric effect is directly utilized. Therefore, the device has an excellent displacement efficiency, a largely generated displacement amount and a high response speed. Therefore, when the device is used as the ink jet head, it is possible to realize the printing at a higher speed as compared with a device in which the strain based on the inverse piezoelectric effect is not directly utilized.

Moreover, when the number of the laminated piezoelectric bodies sandwiched between the electrodes is increased, the displacement amount and the displacement generation force (the driving force) of the piezoelectric element can easily be improved. Therefore, it is possible to handle and discharge a highly viscous liquid as the fluid.

In the preferable configuration of the discharge device according to the present invention, the side surfaces of the piezoelectric element formed by the laminated sections of the layered piezoelectric bodies and electrodes laminated alternately are constituted of the fired surfaces, and the surfaces are not formed by the mechanical processing. Therefore, any residual stress due to the mechanical processing is not generated, and stabilized piezoelectric characteristics (the displacement and the response) are obtained. A stress generated during the mechanical processing microscopically remains on the surface of an outer peripheral portion (the side surface) of the piezoelectric element obtained by the conventional mechanical processing. When the voltage is applied to the piezoelectric element, an electric dipole in the material rotates to thereby generate the stress. As a result, the displacement is caused. However, when the stress generated during the mechanical processing remains, problems might occur that the stress related to the displacement deviates and that the piezoelectric characteristics fluctuate and become unstable. According to the preferable configuration of the discharge device of the present invention, such a problem can be avoided. In the piezoelectric body, internally destroyed crystal particles are not present. Defects such as micro cracks generated by such destruction are hardly present in the body. Therefore, when the driving voltage is applied between the electrodes, the strain generated in the piezoelectric body is obtained from all of the crystal particles. There is little strain or transmission loss, and it is possible to obtain a large displacement amount of the piezoelectric element and a large value of the displacement generation force.

In the preferable configuration of the discharge device according to the present invention, the piezoelectric body is not sandwiched between the electrodes constituting the piezoelectric element in the vicinity of the support wall, and a portion of the piezoelectric element disposed close to the inactive support wall becomes inactive in the same manner as in the support wall. Therefore, the inactive portion of the piezoelectric element produces a buffering function between the inactive support wall and the active portion of the piezoelectric element in which the displacement is generated, and the generation of the cracks is inhibited. The discharge device according to the present invention has a configuration in which the piezoelectric elements are spread between the pair of support walls. Therefore, when all of the piezoelectric elements are active portions, the stress is concentrated on a boundary between the active portion and the inactive support wall, and the cracks might easily be generated. However, according to this preferable configuration, such a problem does not easily occur.

In the preferable configuration of the discharge device according to the present invention, the channel section is formed of the ceramic material which is not easily corroded and which has an excellent corrosion resistance. Therefore, there is not any restriction on the fluid to be discharged, and a large number of types of fluids can be discharged. In the conventional ink jet head having the channel section obtained by bonding metal plates with an adhesive, it is not possible to discharge a liquid other than a water soluble liquid, and a liquid such as an organic solvent based liquid or a corrosive liquid cannot be discharged. However, according to the present invention, it is possible to handle and discharge such a liquid. In addition, as described above, in the preferable configuration of the discharge device according to the present invention, it is possible to handle a highly viscous liquid. Therefore, in a case where a configuration in which these characteristics are combined and used, it is possible to realize a discharge device having excellent fluid handling properties and a broad range of allowable fluids to be handled. It can then be said that a preferable characteristic of the present discharge device is that the quality of the various liquids (the fluid) selected and suitable for this ink jet head is not restricted to only the types of ink used in recent years to achieve a long life of the printed matter. When the channel section is formed of the ceramic material, the channel section and the actuator section can integrally be prepared by a green sheet laminating method, and the device can have an excellent production efficiency.

In the preferable configuration of the discharge device according to the present invention, since any retreated step portion is not present in the channel section, the fluid to be discharged is not easily accumulated. Therefore, when the discharge device according to the present invention is used as, for example, the ink jet head, it is possible to realize the high-quality printing.

Moreover, in recent years, the discharge device has been required to discharge the liquid in a situation in which a plurality of liquids are mixed and characteristics are changed. For example, after one liquid is discharged using one liquid chamber and channel, the device is cleaned. Next, to discharge another liquid, in the conventional ink jet head or a discharge device based on this head, since the retreated step portion is generated in the liquid chamber or the channel, there is a problem that the previous (one) liquid which cannot be removed by the cleaning remains in the retreated step portion, and is unavoidably mixed with another liquid for use next, and the characteristics of the next (other) liquid change. According to the preferable configuration of the discharge device of the present invention, is that any retreated step portion is not present and then the mixing of the liquids does not occur. Even when the liquid to be discharged changes, the problem does not occur that the characteristics of the liquid change. As a specific example, to discharge a DNA liquid, when another DNA liquid is mixed, a problem occurs that sensitivity of the DNA liquid deteriorates. In consequence, this preferable configuration of the discharge device according to the present invention is preferably usable as a discharge device of a DNA chip manufacturing apparatus.

DESCRIPTION OF THE PREFERRED EMBODIMENT

Figure 1:
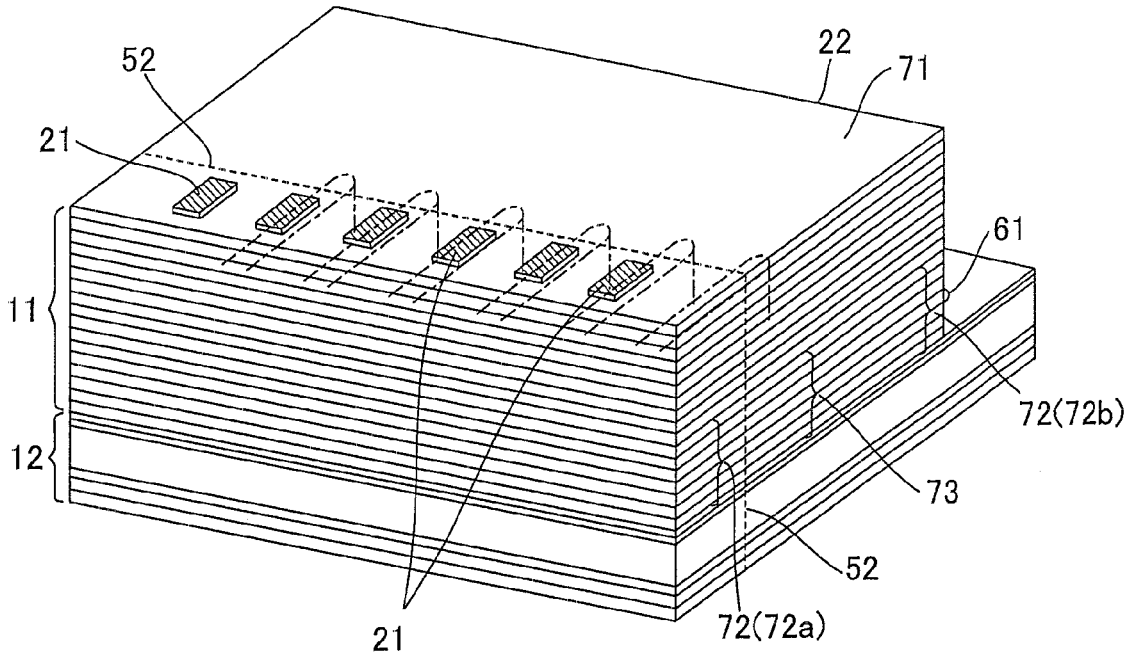
FIG. 1 is a perspective view showing an appearance of one embodiment of a discharge device according to the present invention.

An embodiment of the present invention will hereinafter be described appropriately with reference to the drawings, but the present invention should not be interpreted in a restrictive manner. The present invention can variously be changed, modified, improved and replaced based on knowledge of any person skilled in the art without departing from the scope of the present invention. For example, the drawings show preferable embodiments of the present invention, but the present invention is not limited to configurations shown in the drawings or information shown in the drawings. To implement or verify the present invention, means similar or equivalent to means described in the present specification are applicable, but preferable means are the following means.

Figure 2:
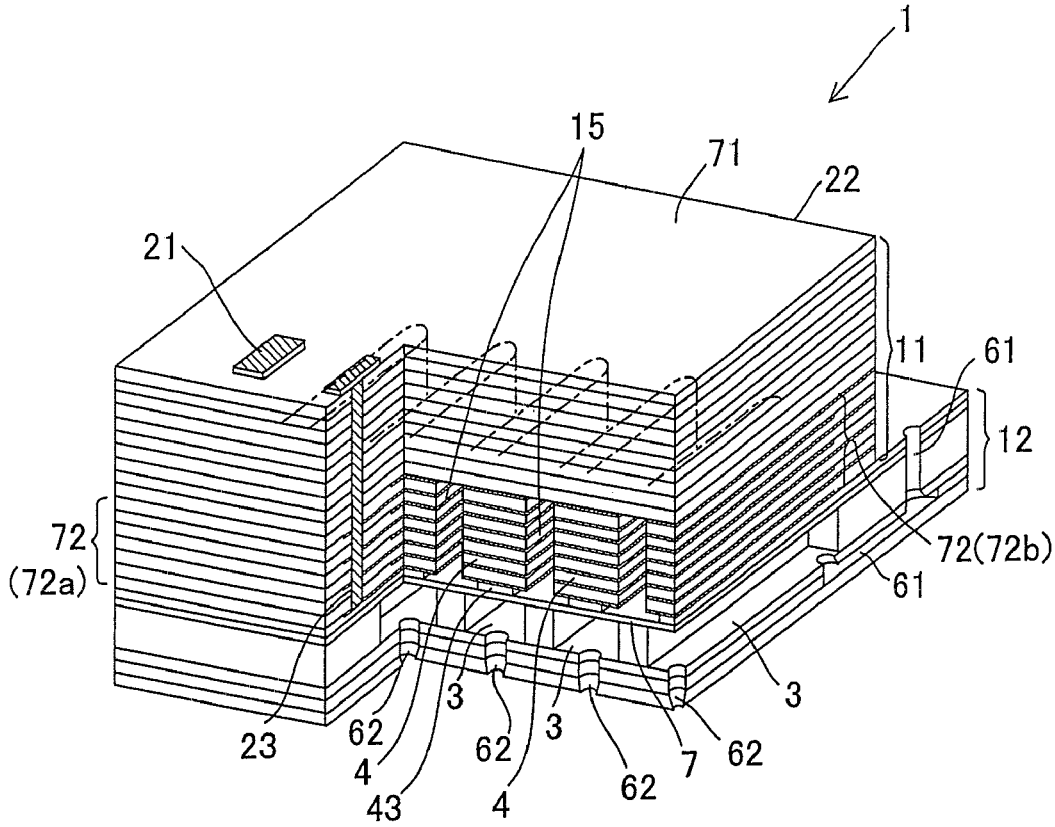
FIG. 2 is a perspective view showing an exposed inner part of the discharge device shown in FIG. 1 cut along one cutting line.
Figure 3:
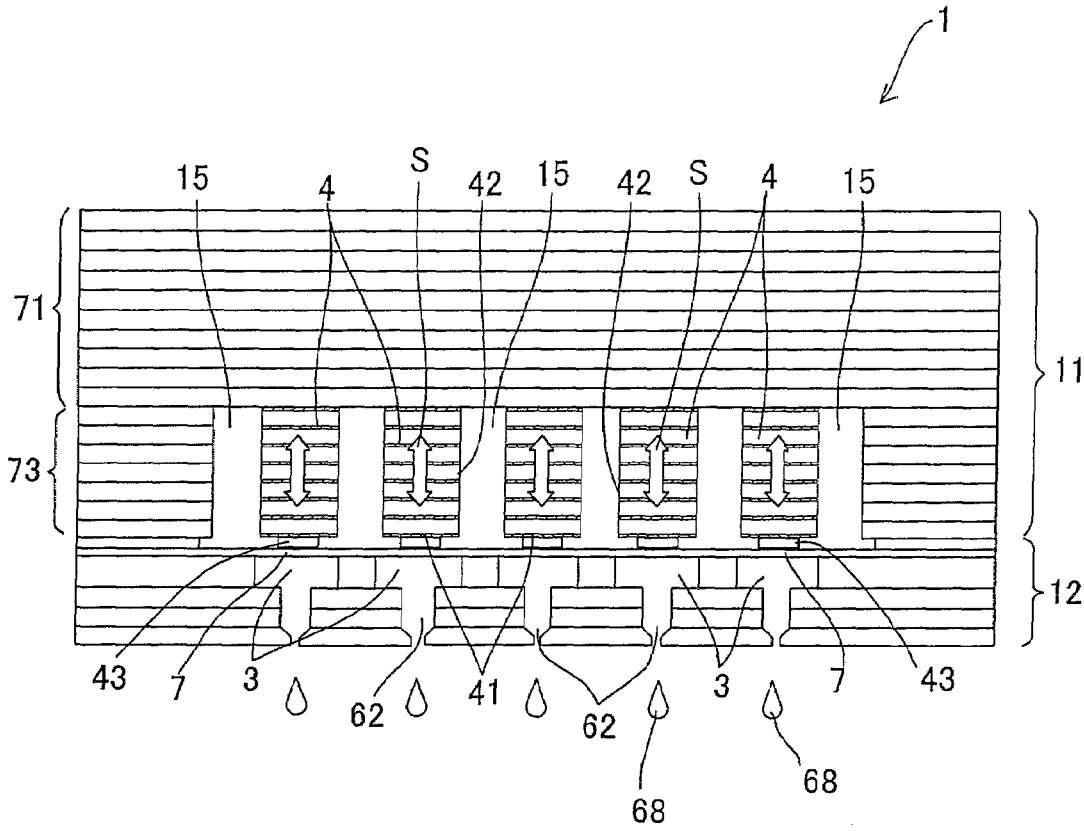
FIG. 3 is a sectional view showing an exposed inner part of the discharge device shown in FIG. 1 cut along another cutting line.
Figure 4A:
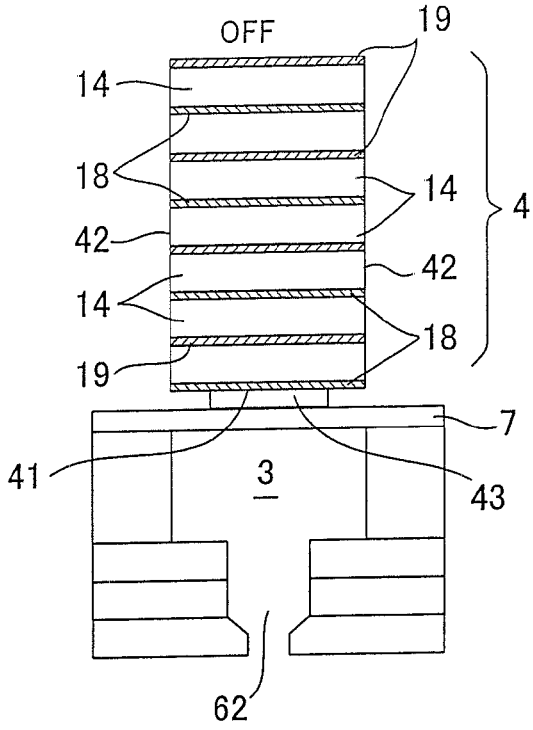
FIGS. 4(*a*)-4(*b*) are sectional, views showing one embodiment of the discharge device according to the present invention, FIG. 4(*a*) is a diagram showing an OFF state in which any displacement is not generated in a piezoelectric element, and FIG. 4(*b*) is a diagram showing an ON state in which displacement to expand the piezoelectric element is generated.
Figure 4B:
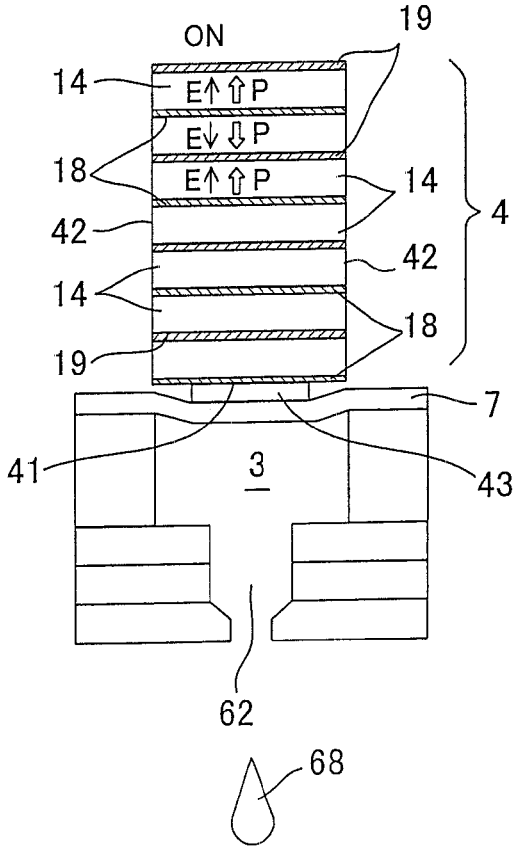
Figure 5:
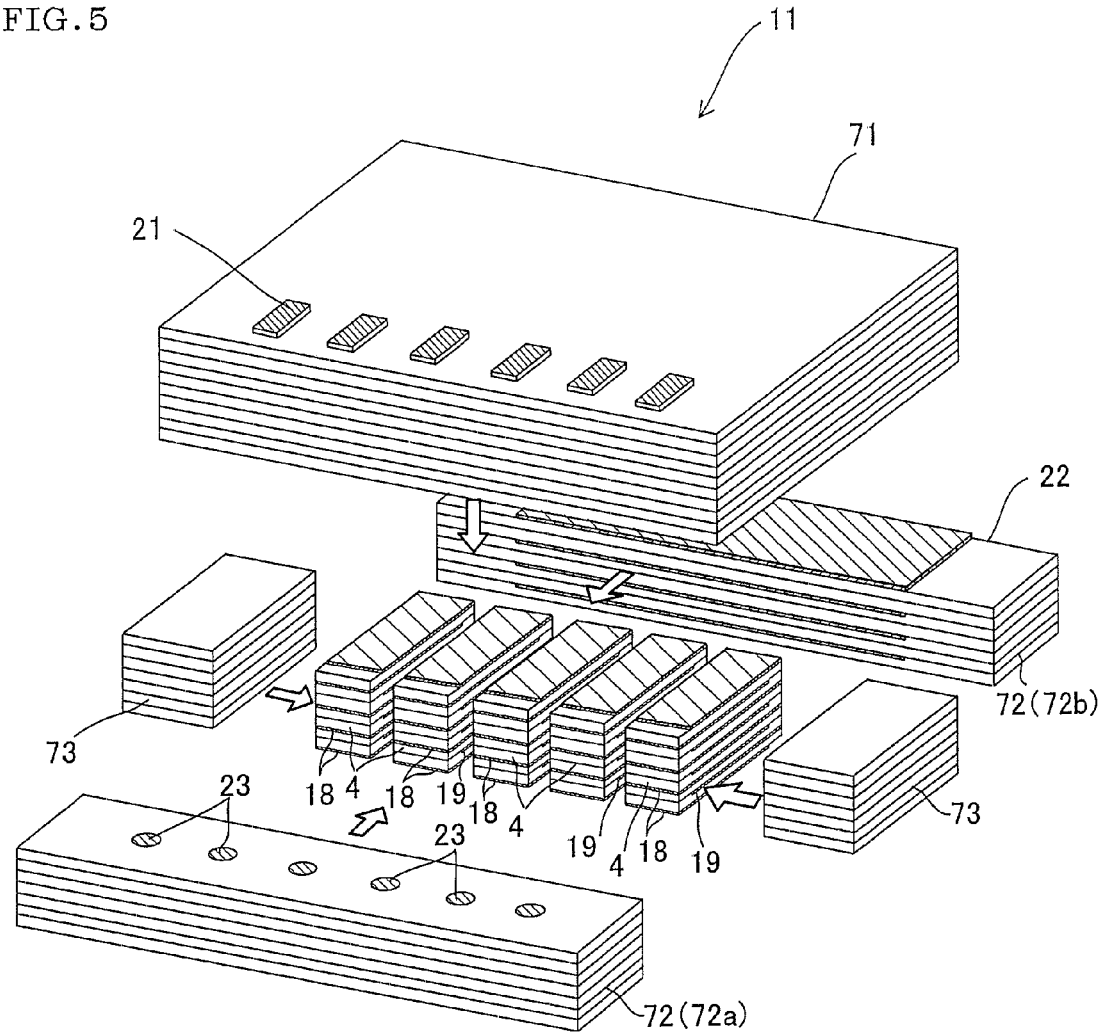
FIG. 5 is an exploded perspective view (an explanatory view) showing elements constituting one embodiment of the discharge device according to the present invention so as to facilitate understanding of a structure.

FIGS. 1 to 5 are diagrams showing one embodiment of a discharge device according to the present invention. FIG. 1 is a perspective view showing an appearance, and FIG. 2 is a perspective view in which an inner part of a discharge device 1 shown in FIG. 1 is exposed. FIG. 3 is a sectional view showing the discharge device 1 shown in FIG. 1 cut along a cutting line 52. FIG. 4 is a sectional view showing a driving state (a generated displacement state) of a piezoelectric element 4 and showing a behavior in which a pressurizing chamber 3 is deformed by the element, FIG. 4(*a*) shows an OFF state (a usual state of a capacity of the pressurizing chamber 3) in which the piezoelectric element 4 is not deformed, and FIG. 4(*b*) shows an ON state (a state in which the capacity of the pressurizing chamber 3 is reduced) in which the piezoelectric element 4 is expanded and displaced. FIG. 5 is an exploded perspective view showing each constituting element of an actuator section 11 of the discharge device 1 shown in FIG. 1 so as to facilitate understanding of a structure.

The discharge device 1 shown in FIGS. 1 to 5 include a channel section 12 and an actuator section 11. In the channel section 12, (for example,) five channels are formed, each channel including an introduction hole 61 into which a fluid such as a liquid is introduced, the pressurizing chamber 3 which communicates with the introduction hole 61 and a discharge hole 62 which communicates with the pressurizing chamber 3 to discharge the liquid. In the actuator section 11, (for example,) five piezoelectric elements 4 hang from a top plate 71, and are spread between a pair of support walls 72 arranged at opposite ends of the top plate 71. In the discharge device 1, portions of the piezoelectric element 4 other than a distal end surface 41 and side surfaces 42 are fixed to the top plate 71 or the support walls 72. Moreover, as clearly shown in FIG. 5, the piezoelectric elements 4 are arranged completely independently of one another via each space 15 sandwiched between the elements. Pier walls 73 are inactive wall portions (solid portions) arranged externally from opposite sides of the piezoelectric elements 4 and arranged in parallel with the piezoelectric elements 4 so that the walls are combined with the pair of support walls 72 to constitute a frame.

In the discharge device 1, there is a one-to-one correspondence between the piezoelectric elements 4 and five channels (the introduction holes 61, the pressurizing chambers 3 and the discharge holes 62). The number of the piezoelectric elements 4 is the same as that of the channels. In FIG. 5, elements constituting the actuator section 11 are separately shown, but in the discharge device 1, all of the elements constituting the actuator section 11 and the channel section 12 are all formed of the same piezoelectric ceramic material except electric circuit portions such as electrodes, and are integrally fired by a manufacturing method based on a green sheet laminating method described later to obtain the device. Therefore, when the channel section 12 is prepared, any adhesive or adhesive sheet is not used, and any retreated step portion is not present in the channel section 12.

As shown in FIGS. 4(*a*)-4(*b*), the piezoelectric element 4 is a laminated piezoelectric element having (for example) seven layers of layered piezoelectric bodies 14 and (for example) eight layers of layered electrodes 18, 19 in total. The electrodes 18 and 19 are alternately laminated via the piezoelectric bodies 14 sandwiched between the electrodes so that a driving voltage can be applied to the piezoelectric bodies 14. In the piezoelectric element 4, an electric field E is applied in the same direction as a polarization direction P of the piezoelectric bodies 14. In consequence, based on a vertical effect, expansion/contraction displacement is generated in a laminating direction (a vertical direction in FIGS. 4(*a*)-4(*b*), a direction shown by each arrow S in FIG. 3).

In the discharge device 1, a ceiling wall 7 of the pressurizing chamber 3 constituting the channel of the channel section 12 is a thin wall which is relatively thinner than another wall portion of the channel section 12. The distal end surface 41 (a lower end surface in FIGS. 2 to 5) of the piezoelectric element 4 of the actuator section 11 abuts on or is secured to the ceiling wall 7 via a protruding portion 43 to integrate the actuator section 11 and the channel section 12. Moreover, when the piezoelectric element 4 shifts from the OFF state (see FIG. 4(*a*)) to the ON state to cause the expansion displacement, the ceiling wall 7 is thrust and bent by the expansion displacement of the piezoelectric element 4 to reduce a capacity of the pressurizing chamber 3 (see FIG. 4(*b*)). When this operation is performed, the liquid in the pressurizing chamber 3 is pressurized and discharged as a liquid droplet 68 from the discharge hole 62. When the piezoelectric element 4 is brought into the OFF state again and contracts (returns to an original state), the ceiling wall 7 returns to a flat state to restore the capacity of the pressurizing chamber 3 (see FIG. 4(*a*)). When this operation is performed, the liquid is sucked and introduced into the pressurizing chamber 3 from the introduction hole 61.

In the discharge device 1, the side surfaces 42 of the piezoelectric element 4 are constituted of fired surfaces, not surfaces subjected to mechanical processing. This is realized by performing a step of forming a laminated green body including the space 15 formed beforehand by the manufacturing method based on the green sheet laminating method described later.

Moreover, in the discharge device 1, one of the electrodes 18 and 19 constituting each piezoelectric element 4 is not present in the vicinity of the support wall 72. Specifically, on a proximal side in FIG. 2 or 5 (in the vicinity of the support wall 72 (72*a*), four layers of electrodes 19 as common electrodes are not present. On the other hand, there are four layers of electrodes 18 which are signal electrodes. The electrodes 18 are further extended into the support wall 72 (72*a*), connected to one another via a via hole 23 extending through the support wall 72*a* and connected to signal terminals 21 formed on the top plate 71. In the vicinity of the support wall 72 (72*b*) on an opposite side, a reverse configuration is constituted. That is, on a distal side of the piezoelectric element 4 in FIG. 2 or 5, in the vicinity of the support wall 72 (72*b*), four layers of electrodes 18 which are the signal electrodes are not present. On the other hand, four layers of electrodes 19 which are the common electrodes are present. The electrodes 19 are further extended into the support wall 72 (72*b*), and all the electrodes 19 are connected to a common terminal 22 formed on the back surface (an invisible surface in FIGS. 2 and 5) of the actuator section 11. In the vicinity of the support wall 72*a* or 72*b*, since the piezoelectric body 14 is not sandwiched between the electrodes 18 and 19, the piezoelectric element 4 has an inactive portion, is connected to the support walls 72*a* and 72*b* via the inactive portion, and constitutes a bridge between the support walls 72*a* and 72*b*.

One embodiment of the discharge device according to the present invention has been described above. Next, a method of manufacturing the discharge device according to the present invention will be described. It is to be noted that in the present specification, a green sheet is also referred to simply as a sheet.

The discharge device according to the present invention can be manufactured by steps of separately preparing the top plate, the support walls, the pier walls and the piezoelectric elements; assembling the components while laminating them to obtain the actuator section; further making a hole in a square ceramic substrate by mechanical processing to form a channel and obtain the channel section; bonding the actuator section and the channel section; and then integrally firing the sections. However, in such a method, it is difficult to handle the piezoelectric element alone. There is a possibility that precisions are insufficient in assembling the actuator section and positioning the actuator section and the channel section during the bonding, and the method has an unsatisfactory productivity. To solve the problem, the discharge device according to the present invention is manufactured using the method of manufacturing the discharge device according to the present invention based on the green sheet laminating method. It is preferable to adopt steps of integrally forming the top plate, the support walls, the pier walls and the piezoelectric elements which are the elements constituting the actuator section; further integrating the channel section to obtain the laminated green body before firing; and then firing the body completely integrally.

The method will hereinafter be described assuming the above-described discharge device 1 shown in FIGS. 1 to 5 as a preparation object. First, the predetermined number of green sheets each including a ceramic material as a main component and having a predetermined thickness are prepared. The green sheets can be prepared by a heretofore known ceramic manufacturing method. For example, piezoelectric ceramic material powder is prepared, and this powder is blended with a binder, a solvent, a dispersant, a plasticizer and the like to obtain a desired composition and prepare a slurry. After subjecting this slurry to a defoaming treatment, sheets can be formed by a sheet forming process such as a doctor blade process, a reverse roll coater process or a reverse doctor roll coater process.

Next, five green sheets (green sheets A) of the prepared green sheets are used. When these sheets are laminated, a hole portion (hole portion a) is made in the sheets to constitute a channel including the introduction holes 61, the pressurizing chambers 3 and the discharge holes 62 (step 1a). Subsequently, it is preferable to use thicker sheets in the green sheets constituting portions (the other portions) other than the ceiling wall 7 among wall portions forming later the pressurizing chambers 3.

Moreover, among the prepared green sheets, seven green sheets (green sheets B) are used, and conductive films constituting the electrodes 18, 19 are formed on the green sheets (step 1b). Next, a hole portion (hole portion b) is made which constitutes later the spaces 15 among five piezoelectric elements 4 arranged independently of one another. The hole portion may first be made before forming the conductive films. In a portion constituting the support wall 72*a*, through holes constituting the via holes 23 are made beforehand in a portion (an extended portion) on which conductive films constituting the electrodes 18 are formed. These sheets are cut into lengths shorter than those of the green sheets A.

Sheet solid portions provided with the conductive films between the spaces 15 are laminated later to constitute the piezoelectric bodies 14 and the electrodes 18, 19 of the piezoelectric element 4. Moreover, even in subsequent steps, this piezoelectric element 4 portion is not subjected to any processing. Therefore, in the discharge device 1 obtained by the firing, surfaces constituting the side surfaces 42 of the piezoelectric element 4 are non-processed after fired, and are fired surfaces as they are.

Furthermore, among the prepared green sheets, ten green sheets (green sheets C) are used, through holes constituting the via holes 23 which communicate with the signal terminals 21 are made, and the sheets are prepared so as to constitute the top plate 71 (step 1c). One thick green sheet may be used as the top plate 71. These sheets are cut into lengths shorter than those of the green sheets A in accordance with the green sheets B.

Moreover, the green sheets (green sheets A) provided with the hole portion (hole portion a) are laminated so as to form the channels constituted of the introduction holes 61, the pressurizing chambers 3 and the discharge holes 62. Moreover, to form the piezoelectric elements 4, the green sheets (green sheets B) provided with the hole portion (hole portion b) and the conductive film, and a green sheet for forming the protruding portion 43 on each distal end surface 41 of the piezoelectric element 4 are laminated. The green sheets (green sheets C) prepared so as to form the top plate 71 are laminated. Furthermore, these three laminated bodies are further laminated and attached under pressure to form a laminated green body. In the laminated green body, the through holes constituting the via holes 23 are filled with a conductive material, and a conductive film constituting the signal terminals 21 are formed so as to be connected to the filled conductive material. On a side constituting the support wall 72*b*, conductive films constituting the common electrodes are formed on a side surface of a portion constituting the actuator section 11 so that the films are connected to conductive films (extended portions of the films) constituting the electrodes 19. Subsequently, the laminated green body subjected to these treatments is dried, fired and integrated as needed to obtain a fired laminated body (second step). Moreover, if necessary, the body is subjected to a wiring line treatment to the outside, a polarization treatment, a coating treatment (sealing) with a protective film (an insulating film) and the like to obtain the discharge device 1.

It is to be noted that the conductive film can be formed in a desired pattern by a technology such as screen printing. The hole portion can be formed by punching and use of, for example, a punch and a die. Furthermore, in addition to the above method, the via hole 23 may be formed, when the through hole is made in each sheet and constituting the via hole 23 to be filled with a conductive material in each sheet during screen printing before the laminating. In addition, as means for forming the protruding portion 43 on the distal end surface 41 of the piezoelectric element 4, instead of laminating beforehand the green sheets for forming the protruding portion 43 on a side constituting the actuator section 11, a method can be adopted in which the green sheet constituting the ceiling wall 7 on a channel section 12 side is formed into a thickness larger than that of the final ceiling wall 7, and the green sheet is thinned by etching or the like so as to leave the protruding portion 43.

Next, materials for use in the discharge device according to the present invention will be described. First, the material (the piezoelectric ceramic material) of the piezoelectric body will be described. There is not any restriction on the material as long as the ceramic material generates an electrically induced strain such as a piezoelectric effect or an electrostrictive effect. A semiconductor ceramic, a ferroelectric ceramic or an antiferroelectric ceramic is usable, and may appropriately be selected for use in accordance with this application. A material which requires or does not require the polarization treatment may be used.

Specifically, preferable examples of the material include lead zirconate, lead titanate, lead magnesium niobate, lead nickel niobate, lead nickel tantalate, lead zinc niobate, lead manganese niobate, lead antimony stannate, lead manganese tungstate, lead cobalt niobate, lead magnesium tungstate, lead magnesium tantalate, barium titanate, sodium bismuth titanate, bismuth neodymium titanate (BNT), potassium sodium niobate, strontium bismuth tantalate, copper tungsten barium, bismuth ferrate and a compound oxide constituting two or more of them. Moreover, in this material, an oxide may be dissolved such as lanthanum, calcium, strontium, molybdenum, tungsten, barium, niobium, zinc, nickel, manganese, cerium, cadmium, chromium, cobalt, antimony, iron, yttrium, tantalum, lithium, bismuth, tin or copper. Furthermore, a material obtained by adding lithium bismuthate, lead germanate or the like to the above material, such as a material obtained by adding lithium bismuthate or lead germanate to a compound oxide of lead zirconate, lead titanate and lead magnesium niobate, is preferable because high material characteristics can be developed while realizing the firing of the piezoelectric body at a low temperature. The firing of the piezoelectric ceramic material at the low temperature can be realized by adding glass (e.g., silicate glass, borate glass, phosphate glass, germanate glass or a mixture of them). However, since excessive addition causes deterioration of the material characteristics, it is preferable to determine an amount to be added in accordance with required characteristics.

Next, a conductive metal is used as the material of the electrode. It is preferable to use a single metal such as aluminum, titanium, chromium, iron, cobalt, nickel, copper, zinc, niobium, molybdenum, ruthenium, palladium, rhodium, silver, tin, tantalum, tungsten, iridium, platinum, gold or lead; an alloy consisting of two or more of them, such as silver-platinum, platinum-palladium or silver-palladium; or a combination of two or more alloys. Alternatively, a mixture of the above material with aluminum oxide, zirconium oxide, titanium oxide, silicon oxide, cerium oxide, glass or the piezoelectric ceramic material, or cermet. When these materials are selected, it is preferable to select the materials in accordance with a type of the piezoelectric ceramic material.

Besides the piezoelectric body (the piezoelectric element) and the support wall, as the material of the top plate or the channel section formed of the ceramic material, it is possible to use the above piezoelectric ceramic material. In addition, a ceramic material such as cordierite, mullite, zircon, aluminum titanate, silicon carbide, ziconia, spinel, indialite, sapphirine, corundum or titania may be used. In the wall portion forming the pressurizing chamber of the channel section, the ceiling wall is a thin wall (a thin plate) which causes flexural displacement. It is most preferable that the ceiling wall is formed of the same ceramic material as that of another channel section. This is because contraction during the firing is the same, and, therefore, any strain is not easily generated. In addition, when the ceiling wall is prepared by the green sheet laminating method, a laminated sheet portion is not easily peeled. However, since the ceiling wall bends, the largest stress is generated in the center of this ceiling wall. Therefore, to enlarge deformation of the ceiling wall, it is preferable to select a material having a large elastic strain. It is also preferable to use a metal plate or a resin plate in the ceiling wall. Alternatively, a material other than the ceramic material may be used in the ceiling wall, or a ceramic material different from that of the channel section excluding the ceiling wall may be used. In the latter case, after firing the channel section excluding the ceiling wall, the channel section may be bonded to the ceiling wall by use of an adhesive.

It is to be noted that to entirely or partially cover the discharge device with a protective film, as the material of the film, silicon dioxide, silicon nitride, boric acid-phosphoric acid-silicate glass (BPSG), phosphoric acid-silicate glass (PSG) or the like is used.

The discharge device according to the present invention can be used as a piezoelectric ink jet head to be incorporated in a printing apparatus. In addition, the discharge device according to the present invention is preferably used as a DNA chip manufacturing device, a coating device for manufacturing a semiconductor, a chemical synthesis device in a pharmaceutical field, a film forming device and/or any type of micro pump or the like.

What is claimed is:

1. A discharge device comprising:

a channel section in which a plurality of channels are formed, each channel having an introduction hole into which a fluid is introduced, a pressurizing chamber which communicates with the introduction hole and a discharge hole which communicates with the pressurizing chamber to discharge the fluid; and an actuator section having a top plate, a pair of support walls arranged at opposite ends of the top plate and a plurality of piezoelectric elements hanging from the top plate, spread between the pair of support walls, arranged independently of one another and forming pairs with the channels, the top plate, the pair of support walls and the plurality of piezoelectric elements being formed of a ceramic material and integrally fired, ceiling walls of the pressurizing chambers constituting the channels of the channel section being relatively thin walls as compared with another portion, the actuator section being attached to the channel section so as to allow distal end surfaces of the piezoelectric elements hanging from the top plate of the actuator section to abut on the ceiling walls, the ceiling walls being bent by displacements of the piezoelectric elements to change capacities of the pressurizing chambers, the fluid being pressurized to discharge the fluid from the discharge holes.

2. The discharge device according to claim 1, further comprising:

pier walls arranged in parallel with the piezoelectric elements and hanging from the top plate externally from opposite sides of the plurality of arranged piezoelectric elements, the pier walls being formed of a ceramic material and fired integrally with the top plate.

3. The discharge device according to claim 1, wherein each of the plurality of piezoelectric elements of the actuator section has layered piezoelectric bodies and electrodes which are alternately laminated, and generates the displacement by a vertical effect.

4. The discharge device according to claim 3, wherein side surfaces of the piezoelectric element formed by laminated sections of the layered piezoelectric bodies and electrodes which are alternately laminated are constituted of fired surfaces.

5. The discharge device according to claim 3, wherein the piezoelectric body is not sandwiched between the electrodes constituting the piezoelectric element in the vicinity of the support wall.

6. A method of manufacturing the discharge device according to claim 3, comprising:

a step 1a of preparing a plurality of green sheets A including a ceramic material as a main component, and making hole portions a constituting channels during laminating in the green sheets A;

a step 1b of preparing a plurality of green sheets B including a piezoelectric ceramic material as a main component, forming conductive films constituting later the electrodes on the green sheets B and then making hole portions b forming later spaces among the plurality of piezoelectric elements arranged independently of one another in the green sheets B;

a step 1c of preparing a green sheet C including a ceramic material as a main component and constituting a top plate later; and a second step of laminating the green sheets A including the hole portions a so as to form the channels, laminating the green sheets B including the conductive films and the hole portions b so as to form the piezoelectric elements, laminating the green sheet C on the green sheets B, pressing the whole green sheets to form a laminated green body, and integrally firing the laminated green body to obtain a fired laminated body.

7. The discharge device according to claim 1, wherein any retreated step portion is not present in the channel section.

8. The discharge device according to claim 1, wherein the channel section is formed of a ceramic material.

9. The discharge device according to claim 1, wherein the actuator section and the channel section are formed of a piezoelectric ceramic material, and integrally fired.

10. A discharge device comprising:

a channel section in which a plurality of channels are formed, each channel having an introduction hole into which a fluid is introduced, a pressurizing chamber which communicates with the introduction hole and a discharge hole which communicates with the pressurizing chamber to discharge the fluid; and an actuator section having a top plate, a pair of support walls arranged at opposite ends of the top plate and a plurality of piezoelectric elements hanging from the top plate, spread between the pair of support walls so that opposite ends of each piezoelectric element are connected to the support walls, respectively, said piezoelectric elements being arranged independently of one another above the channels, the top plate, the pair of support walls and the plurality of piezoelectric elements being formed of a ceramic material and integrally fired, ceiling walls of the pressurizing chambers constituting the channels of the channel section being relatively thin walls as compared with another portion, the actuator section being attached to the channel section so as to allow distal end surfaces of the piezoelectric elements hanging from the top plate of the actuator section to abut on the ceiling walls, the ceiling walls being bent by displacements of the piezoelectric elements to change capacities of the pressurizing chambers, the fluid being pressurized to discharge the fluid from the discharge holes.

11. The discharge device according to claim 10, wherein, in the channel section, all of the piezoelectric elements are laterally spaced away from sidewalls that separate the channels from one another.

* * * * *